US006363733B1

(12) United States Patent
Galembeck

(10) Patent No.: US 6,363,733 B1
(45) Date of Patent: Apr. 2, 2002

(54) REFRIGERATOR, SPECIALLY FOR BEVERAGE BOTTLES, IN PARTICULAR BEER BOTTLES, A SYSTEM OF PRODUCING HUMIDITY FOR A REFRIGERATOR AND A METHOD FOR GENERATING A COVERING OF ICE CRYSTALS ON A BOTTLE

(75) Inventor: Gabriel Galembeck, Campinas (BR)

(73) Assignee: Companhia Cervejaria Brahma, Campinas (BR)

( * ) Notice: Subject to any disclaimer, the term of this patent is extended or adjusted under 35 U.S.C. 154(b) by 0 days.

(21) Appl. No.: 09/648,338

(22) Filed: Aug. 25, 2000

(30) Foreign Application Priority Data

Aug. 26, 1999 (BR) ..... 9903900

(51) Int. Cl.[7] ..... A47F 3/04; F25D 3/00; F25D 25/00; F25C 1/00; F25B 25/00

(52) U.S. Cl. ..... 62/247; 62/59; 62/62; 62/66; 62/457.4; 62/332; 62/347

(58) Field of Search ..... 62/59, 62, 64, 62/66, 247, 457.3, 457.4, 332, 347, 344

(56) References Cited

U.S. PATENT DOCUMENTS 929,389 A * 7/1909 Clement ..... 62/66
4,501,130 A * 2/1985 Izumi ..... 62/247
4,543,801 A * 10/1985 Damiens ..... 62/457.4
5,148,682 A * 9/1992 Wolf ..... 62/59

FOREIGN PATENT DOCUMENTS

| | | | |
|---|---|---|---|
| FR | 2437815 | 4/1980 | |
| FR | 2767045 | 1/2000 | |
| GB | 358392 A * | 10/1931 | 62/247 |
| GB | 2017285 | 10/1979 | |
| GB | 2258299 A * | 2/1993 | 62/247 |
| WO | WO9907261 | 2/1999 | |

* cited by examiner

*Primary Examiner*—William C. Doerrler
(74) *Attorney, Agent, or Firm*—Smith, Gambrell & Russell, LLP

(57) ABSTRACT

A refrigerator is described, specially for beverage bottles, in particular beer bottles, a humidity production system for a refrigerator and a method for generating a COVERING OF ICE CRYSTALS on the bottle. The objective of the invention is to provide an equipment for producing a COVERING OF ICE CRYSTALS on a beverage bottle, in particular beer bottles, which produces a covering of ice crystals regardless of the weather conditions of the place and without causing the freezing of the beverage. This objective is achieved with a refrigerator comprising a humidity production system (4) to produce humidity in the internal compartment (3), the humidity production system (4) having a water feed.

44 Claims, 1 Drawing Sheet

REFRIGERATOR, SPECIALLY FOR BEVERAGE BOTTLES, IN PARTICULAR BEER BOTTLES, A SYSTEM OF PRODUCING HUMIDITY FOR A REFRIGERATOR AND A METHOD FOR GENERATING A COVERING OF ICE CRYSTALS ON A BOTTLE

The present invention refers to a refrigerator, specially for beverage bottles, in particular beer bottles, a system of producing humidity for a refrigerator and a method for generating a covering of ice crystals on a bottle.

DESCRIPTION OF THE PRIOR ART

Depending on several factors, known refrigerators and freezers may produce, in an uncontrollable way, a covering of ice crystals on beverage bottles, due to condensation of ambient humidity on the surface of the bottle and subsequent freezing in the form of crystals. In various cases, however, this effect is achieved when the beverage itself is already frozen or about to freeze. Parameters such as the local temperature and humidity affect the formation of these crystals.

A known piece of equipment from Makooler do Brasil Ltda., commercially called "Gela Rápido", comprises a bath with water/potassium chloride solution, insulated by a plastic film, maintained at −24° C., in which bottles are inserted to obtain super-rapid cooling. In this equipment, if wet bottles are put inside it, an ice covering occurs, but not in the form of crystals.

Document FR 2437815 deals with a refrigerating counter, in which steam is piped and injected into a flow of cold air as it emerges from the evaporator of the refrigeration circuit within the cabinet. The purpose is to maintain the humidity level required by the food preserved inside the refrigerating counter, simultaneously eliminating the need for a complex spraying device, by using water in a liquid state. In this known equipment there is no objective of forming ice, since its operating temperature typically ranges from +2° to +14°.

Similarly, according to FR 2767045, food requiring a high level of fresh water or brine may be stored or exposed in an insulated cabinet, in which air is caused to circulate through refrigerated exchange tubes and in which a mist of fresh water or brine is produced by adjustable nozzles and by a pump. Also in this document the purpose is to provide food with the necessary humidity level, however, without freezing it.

It has been found that consumers of beer prefer bottles with a covering of ice crystals, but without the beer itself being frozen. Of course, the covering of ice crystals conveys to the consumer the feeling that the beer is cold. However, so far no equipment is known that could provide this visual effect in a controlled way, irrespective of the local weather conditions, specially temperature and humidity.

BRIEF DESCRIPTION OF THE INVENTION

The objective of the present invention is therefore to provide an equipment to produce a COVERING OF ICE CRYSTALS on a beverage bottle, specially beer bottles, which produces such ice crystals regardless of the local weather conditions and without causing the beverage to freeze.

This objective is achieved by means of a refrigerator that comprises a humidity production system, as well as a suitable distribution system to feed the humidity generated in the humidity production system to the internal compartment of the refrigerator, the humidity production system having a water feed. In another embodiment, the humidity production system is located in the internal compartment itself of the refrigerator, dispensing with the separate distribution system.

Equally, a humidity production system is proposed, which can be coupled to a conventional refrigerator, the system comprising a humidity-producing unit, a water reservoir and a distribution duct system capable of interconnecting the humidity-producing unit with the internal compartment of a refrigerator.

Finally, the invention proposes a method for generating a COVERING OF ICE CRYSTALS on a bottle in a refrigerator having an internal compartment and a compressor, which comprises the following steps:

producing humidity in a humidity-producing unit, and conveying the humidity produced by the humidity-producing unit to the internal compartment of the refrigerator.

In an embodiment wherein the production of humidity occurs in the internal compartment of the refrigerator, the later step of transporting the unit is dispensed with.

BRIEF DESCRIPTION OF THE DRAWINGS

The present invention will now be described in greater detail with reference to an embodiment represented in the drawings. The figures show.

DETAILED DESCRIPTION OF THE FIGURES

Figure 1:
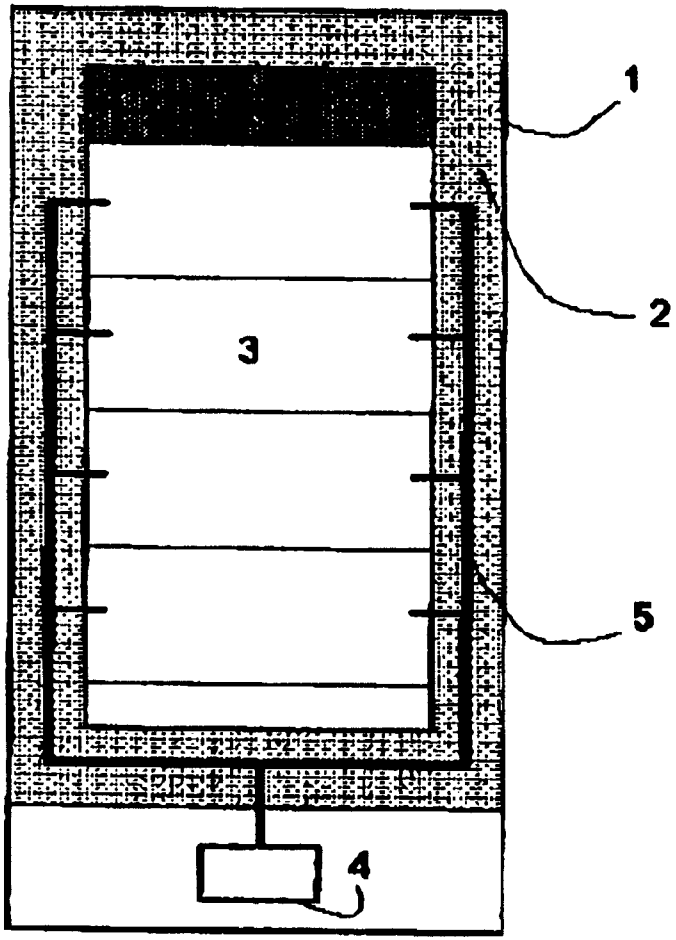
FIG. 1 is a schematic view of a first embodiment of the refrigerator of the present invention.

As can be seen from FIG. 1, in the first embodiment the refrigerator 1 comprises, in a conventional way, an insulator 2 and an internal compartment 3, in addition to a compressor, a thermostat and other usual components. The proposed innovation lies in the humidity-producing system 4 and the respective distribution system or distribution duct 5, which pipes the humidity of the humidity-producing system 4 to the internal compartment 3 of the refrigerator. A fan may be provided (not shown) to force the flow of humid air generated in the humidity production system 4 into refrigerator 3.

Figure 2:
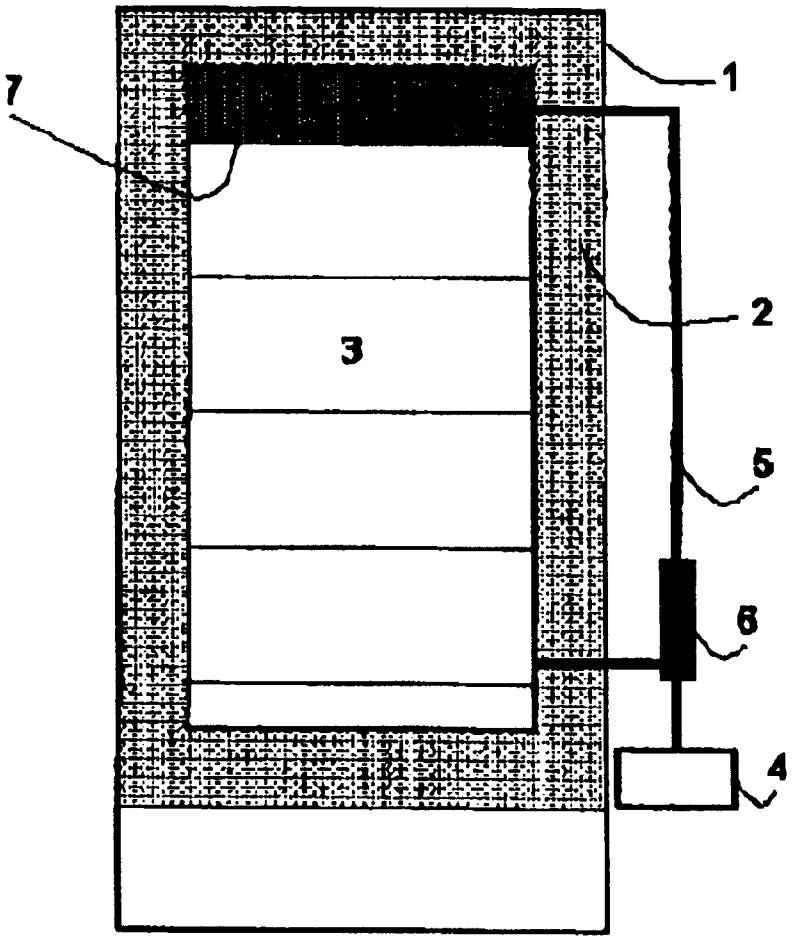
FIG. 2 is a schematic view of a second embodiment of the refrigerator.

The second embodiment, illustrated in FIG. 2, differs from the first one in that the humidity production system 4 and the distribution duct 5 are located outside the refrigerator 1, so as to facilitate the adaptation of a conventional refrigerator to the proposed system. The external assembly can coupled to one of the sides of the refrigerator 1. In this embodiment, a fan 6 is illustrated, which is associated to the distribution duct 5.

In addition, in the embodiment illustrated in FIG. 2, the humidity generated by the humidity-producing unit 4 is discharged into the compartment 7, where the evaporator and the fan of the conventional refrigeration system of the refrigerator are located, that is, the system that controls the temperature of the refrigerator. The fan of the system sucks the air through the evaporator and discharges it into the internal environment 3. Generally, the compartment 7 is separated from the internal environment 3 by a steel plate, there remaining only an aperture of about 5 cm along the refrigerator, which directs the flow of air generated by the fan of the refrigerator to the internal environment 3, from above downwards and from front to back, thus generating an elliptical air flow in the refrigerator. The option for discharging the humidity into the compartment 7 is due to the fact that in this way the installation of the system is facilitated, thus providing the best possible distribution of humidity from a single inlet point.

In the two embodiments, the distribution duct 5 should enable a recirculation of the internal air of the refrigerator, so as to bring about a uniform distribution of the humidity inside the refrigerator.

Also in either of these embodiments a water feed system should be provided to supply the humidity generators. This water feed system may be in a direct manual way, controlled by an operator who fills a reservoir every time it is empty, or it may be an automatic filling system, for instance by making use of the water itself from defrosting the refrigerator or else it may be connected to the mains water via a reservoir with a ball valve. Preferably, the water reservoir of the water feed system is thermally insulated and equipped with a temperature-control system, so that the water will always remain at the temperature suitable for the process.

In either of the embodiments described, the generation of humidity may be made basically in two ways:

first, the humidity-producing unit 4 is a water droplet generator that supplies the water in the form of droplets, and the humidity production system as a whole preferably has a heating system (not shown) to prevent the droplets from freezing inside the distribution duct 5 and to increase the capacity of the air to absorb humidity;

secondly, the humidity-producing unit 4 is an evaporator, for instance of the type similar to a domestic humidifier, which, besides evaporating the water to generate the desired humidity, also produces the heat necessary to raise the capacity of the air to carry humidity.

The effect of generating a COVERING OF ICE CRYSTALS is achieved by ensuring a degree of humidity sufficient to enable condensation of the humidity on the wall of the bottle and subsequent freezing in the form of crystals, thus imparting a whitish appearance to the bottle, but without causing the liquid inside to freeze.

The method of forming the COVERING OF ICE CRYSTALS consists, therefore, of generating humidity and causing it to circulate inside the refrigerator to provide moistening of the walls of the bottles inside it.

An ideal combination of the effect of generating ice crystals with the absence of freezing of the beer occurs at a temperature ranging from −2.5° C. to −7.5° C. In this way, the method of the invention includes adjusting the thermostat of the refrigerator to operate in this temperature range.

The two systems (water droplet generator and evaporator) should work with a water evaporation rate ranging from 1 to 5 ml per minute. The heating power, in the case of the system provided with a coupled resistance, should be in the range 300 to 1200 W.

The temperature of the refrigerator should always be maintained below −2.5° C., even during the cycles of reproduction of humidity. These parameters should be configured according to the duration of the humidity production cycles, capacity and adjustment temperature of the refrigerator, among others.

Although the generation of humidity may occur continuously, preferably, the generation is controlled by a programmer, alternating generation cycles with rest cycles. Preferably, the humidity-generation cycles are combined with the refrigerator cycles, as regards the functioning of the compressor and the defrosting cycles.

Possibly, the defrosting system of a conventional refrigerator should be dimensioned to bear a load of additional heat introduced by the humidity generation system.

Although embodiments have been described and illustrated in which the humidity production system is located outside the internal compartment and the humidity or vapour is carried by ducts into the refrigerator, the scope of the invention also includes embodiments in which the humidity or vapour is directly generated inside the refrigerator, dispensing with distribution ducts.

Having described a preferable embodiment, it should be understood that the scope of the present invention embraces other possible variations, being limited only by the contents of the accompanying claims, including the possible equivalents.

What is claimed is:

1. A refrigerator, specially for beverage bottles, in particular beer bottles, the refrigerator having an internal compartment (3), a heat insulator (2) and a means for cooling the internal compartment, characterized by comprising a humidity production system (4) for producing humidity, in the internal compartment (3) of the refrigerator, the humidity production system (4) comprising a water feed and a water droplet generator suitable to supply water in the form of droplets, with the refrigerator being set to operate at a temperature ranging from −2.5° to −7.5° C., in such a manner as to create a covering of ice crystals on the surface of said bottles.

2. A refrigerator according to claim 1, characterized in that the humidity production system (4) is located outside the internal compartment (3) of the refrigerator, the refrigerator comprising a distribution system (5) suitable to convey the humidity generated in the humidity production system (4) to the internal compartment (3) of the refrigerator.

3. A refrigerator according to claim 2, characterized in that a heating system adequate to prevent the droplets generated by the droplet generator from freezing inside the distribution system (5) is associated to the humidity production system (4).

4. A refrigerator according to claim 2, characterized in that the humidity production system (4) and the respective distribution system (5) are incorporated to the refrigerator (1) inside the latter.

5. A refrigerator according to claim 4, characterized in that ducts of the distribution system (5) are provided in the heat insulator (2) of the refrigerator (1), which lead to several outlet points of the internal compartment (3) of the refrigerator (1).

6. A refrigerator according to claim 2, characterized in that the humidity production system (4) and the respective distribution system (5) are arranged outside the refrigerator (1), the distribution system (5) passing through the heat insulator (2) of the refrigerator (1).

7. A refrigerator according to claim 6, characterized in that the distribution system (5) leads to the compartment (7), where an evaporator and a fan of the conventional cooling system of the refrigerator are located.

8. A refrigerator according to claim 2, characterized in that a fan (6) is provided in the distribution system, which is adequate to force the humidity flow into the internal compartment (3) of the refrigerator (1).

9. A refrigerator according to claim 1, characterized in that the feed includes a water reservoir fed by water from the defrosting of the refrigerator (1), the water reservoir being thermally insulated.

10. The refrigerator according to claim 1, characterized in that the water feed includes a water reservoir and the water reservoir is equipped with a temperature control device.

11. A refrigerator according to claim 1, characterized in that the humidity production system (4) includes a programmer to operate the humidity production in cycles.

12. A method for generating a covering of ice crystals on a bottle in a refrigerator having an internal compartment and a compressor, characterized by the following steps:

producing humidity in a humidity-producing unit (4) with the production of humidity including generating water droplets with a water droplet generator of said humidity producing unit;

conveying the humidity produced by the humidity-producing unit to the internal compartment (3) of the refrigerator (1); and controlling the temperature in the internal compartment (3) of the refrigerator (1) in the range −2.5° C. to −7.5° C.

13. A method for generating a covering of ice crystals on a bottle in a refrigerator having an internal compartment and a compressor, characterized by including the following steps:

producing humidity in a humidity-producing unit (4) which comprises a water droplet generator such that humidity is produced inside the internal compartment (3) of the refrigerator (1); and controlling the temperature of the internal compartment (3) of the refrigerator (1) in the range −2.5 to −7.5° C.

14. A method according to claim 12, characterized in that the humidity is heated by a heating system.

15. A method according to claim 14, characterized in that the power of the heating system ranges from 300 to 1200 W.

16. A method according to claim 12, characterized in that the temperature of the internal compartment of the refrigerator (1) is maintained between −4° C. and −6° C.

17. A method according to claim 12, characterized in that the production of humidity occurs in cycles.

18. A method according to claim 17, wherein the refrigerator operates in intermittent defrosting cycles, characterized in that the cycles of humidity production are combined with the compressor functioning cycles of the refrigerator and/or with the defrosting cycles.

19. A method according to claim 13, characterized in that the temperature of the internal compartment of the refrigerator (1) is maintained between −4° C. and −6° C.

20. A method according to claim 13, characterized in that the production of humidity occurs in cycles.

21. A refrigerator, specially for beverage bottles, in particular beer bottles, the refrigerator having an internal compartment (3), a heat insulator (2) and a means for cooling the internal compartment, characterized by comprising a humidity production system (4) for producing humidity in the internal compartment (3) of the refrigerator, the humidity production system (4) comprising an evaporator, the refrigerator being set to operate at a temperature ranging from −2.5° to −7.5° C., in such a manner as to create a covering of ice crystals on the surface of said bottles.

22. A refrigerator according to claim 21, characterized in that the humidity production system (4) is located outside the internal compartment (3) of the refrigerator, the refrigerator comprising a distribution system (5) suitable to convey the humidity generated in the humidity production system (4) to the internal compartment (3) of the refrigerator.

23. A refrigerator according to claim 22, characterized in that the humidity production system (4) and the distribution system (5) are incorporated inside the refrigerator (1).

24. A refrigerator according to claim 23, characterized in that ducts of the distribution system (5) are provided in the heat insulator (2) of the refrigerator (1), which lead to several outlet points of the internal compartment (3) of the refrigerator (1).

25. A refrigerator according to claim 22, characterized in that the humidity production system (4) and the distribution system (5) are arranged outside the refrigerator (1), the distribution system (5) passing through the heat insulator (2) of the refrigerator (1).

26. A refrigerator according to claim 25, characterized in that the distribution system (5) leads to the compartment (7), where an evaporator and a fan of the conventional cooling system of the refrigerator are located.

27. A refrigerator according to claim 22, characterized in that a fan (6) is provided in the distribution system, which is adequate to force the humidity flow into the internal compartment (3) of the refrigerator (1).

28. A refrigerator according to claim 21, characterized in that the humidity production system includes a water feed and the water feed includes a water reservoir fed by water from the defrosting of the refrigerator (1), the water reservoir being thermally insulated.

29. A refrigerator according to claim 21, characterized in that the humidity production system includes a water reservoir which is equipped with a temperature-control device.

30. A refrigerator according to claim 21, characterized in that the humidity production system (4) includes a programmer to operate the humidity production in cycles.

31. A method for generating a covering of ice crystals on a bottle in a refrigerator having an internal compartment and a compressor, characterized by the following steps:

producing humidity in a humidity-producing unit (4) comprising an evaporator;

conveying the humidity produced by the humidity-producing unit to the internal compartment (3) of the refrigerator (1); and controlling the temperature in the internal compartment (3) of the refrigerator (1) in the range −2.5° C. to −7.5° C.

32. A method according to claim 31 wherein the temperature of the internal compartment of the refrigerator (1) is maintained between −4° C. and −6° C.

33. A method according to claim 31 wherein the humidity-producing unit (4) operates at a rate of water evaporation ranging from 1 to 5 ml per minute.

34. A method according to claims 31 wherein the production of humidity occurs in cycles.

35. A method according to claim 34, wherein the refrigerator operates in intermittent defrosting cycles, wherein the cycles of humidity production are combined with the compressor functioning cycles of the refrigerator and/or with the defrosting cycles.

36. A method for generating a covering of ice crystals on a bottle in a refrigerator having an internal compartment and a compressor, characterized by including the following steps:

producing humidity in a humidity-producing unit (4) comprising an evaporator inside the internal compartment (3) of the refrigerator (1); and controlling the temperature of the internal compartment (3) of the refrigerator (1) in the range −2.5° C. to −7.5° C.

37. A method according to claim 36 wherein the temperature of the internal compartment of the refrigerator (1) is maintained between −4° C. and −6° C.

38. A method according to claim 36 wherein the humidity-producing unit (4) operates at a rate of water evaporation ranging from 1 to 5 ml per minute.

39. A method according to claims 36 wherein the production of humidity occurs in cycles.

40. A method according to claim 39, wherein the refrigerator operates in intermittent defrosting cycles, wherein the cycles of humidity production are combined with the compressor functioning cycles of the refrigerator and/or with the defrosting cycles.

41. A refrigerator, specially for beverage bottles, in particular beer bottles, the refrigerator having an internal compartment (3), a heat insulator (2) and a means for cooling the internal compartment, characterized by comprising a humidity production system (4) for producing humidity, in the internal compartment (3) of the refrigerator, said humidity production system (4) having a water feed, the refrigerator being set to operate at a temperature ranging from −2.5° C. to −7.5° C., said humidity production system (4) being located outside the internal compartment (3) of the refrigerator, said refrigerator comprising a distribution system (5) suitable to convey the humidity generated in said humidity production system (4) to the internal compartment (3) of the refrigerator, said humidity production system (4) further comprising a water droplet generator suitable to supply water in the form of droplets, wherein a heating system adequate to prevent the droplets generated by said water droplet generator from freezing inside said distribution system (5) is associated to said humidity production system (4).

42. A method of generating a covering of ice crystals on a bottle inside a refrigerator having an internal compartment and a compressor, wherein the ice covering is produced in a controlled manner, comprising:

producing humidity in a humidity-producing unit (4), conveying the humidity produced by said humidity-producing unit into said internal compartment (3) of the refrigerator (1), and maintaining the temperature in the internal compartment (3) of the refrigerator (1) in the range of −2.5° C. to −7.5° C.

43. The method according to claim 42, wherein the humidity-producing unit (4) is an evaporator.

44. The method according to claim 42, wherein the humidity-producing unit (4) is a water droplet generator associated with a heating system adequate to prevent the droplets generated by said water droplet generator from freezing.

* * * * *